United States Patent [19]

Kuhn

[11] 4,169,336

[45] Oct. 2, 1979

[54] STRETCHABLE FIGURE EXHIBITING SLOW RECOVERY

[75] Inventor: James O. Kuhn, New York, N.Y.

[73] Assignee: CPG Products Corporation, Minneapolis, Minn.

[21] Appl. No.: 826,293

[22] Filed: Aug. 22, 1977

Related U.S. Application Data

[63] Continuation of Ser. No. 705,966, Jul. 16, 1976, abandoned, which is a continuation-in-part of Ser. No. 665,469, Mar. 10, 1976, abandoned.

[51] Int. Cl.[2] ..... A63H 3/00

[52] U.S. Cl. ..... 46/156

[58] Field of Search ..... 46/151, 152, 156; 272/8 N

[56] References Cited

U.S. PATENT DOCUMENTS

| | | | |
|---|---|---|---|
| 3,347,545 | 10/1967 | Nichols | 272/8 N |
| 3,380,184 | 4/1968 | Fernandez | 46/152 |
| 3,601,923 | 8/1971 | Rosenberg | 46/151 |

*Primary Examiner*—F. Barry Shay

*Attorney, Agent, or Firm*—Gene O. Enockson

[57] ABSTRACT

A toy figure is provided having skin of elastic film and a filling of a high viscosity material, the viscosity of such filling remaining constant under shear. The skin may be of natural or synthetic rubber capable of recovery after stretching of 300 percent of its original dimensions. The filling viscosity is in the range of $5\times10^3$ to $5\times10^8$ centipoises.

7 Claims, 9 Drawing Figures

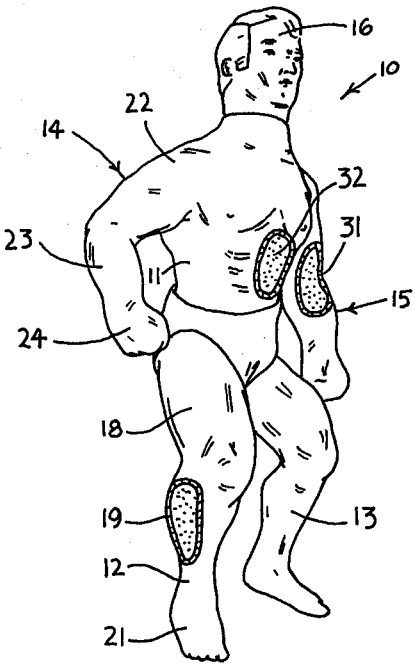
FIG. I
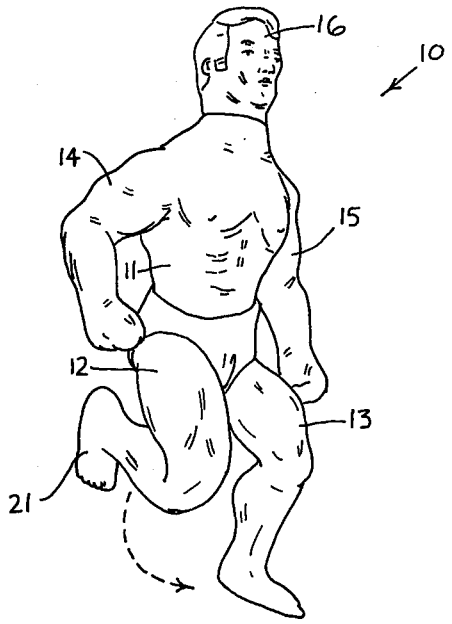
FIG. II
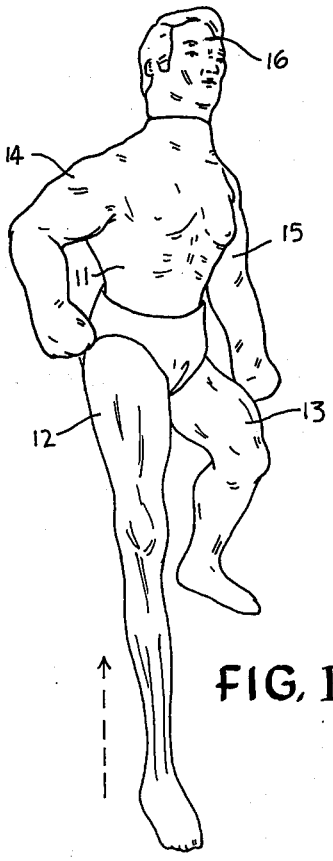
FIG. III
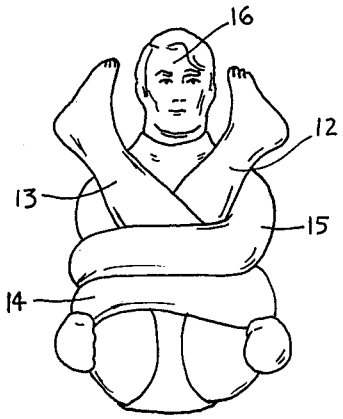
FIG. IV

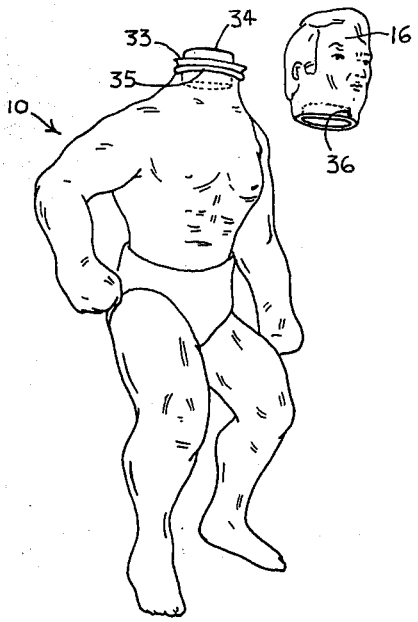
FIG. V
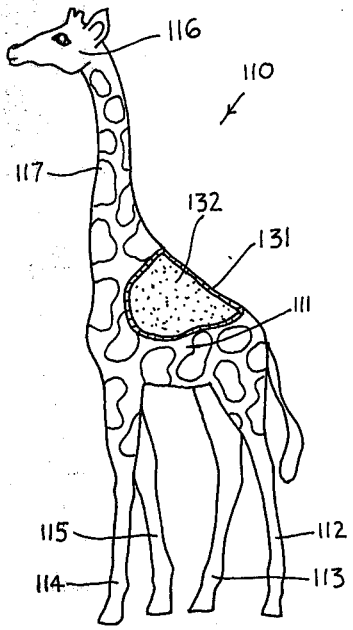
FIG. VI
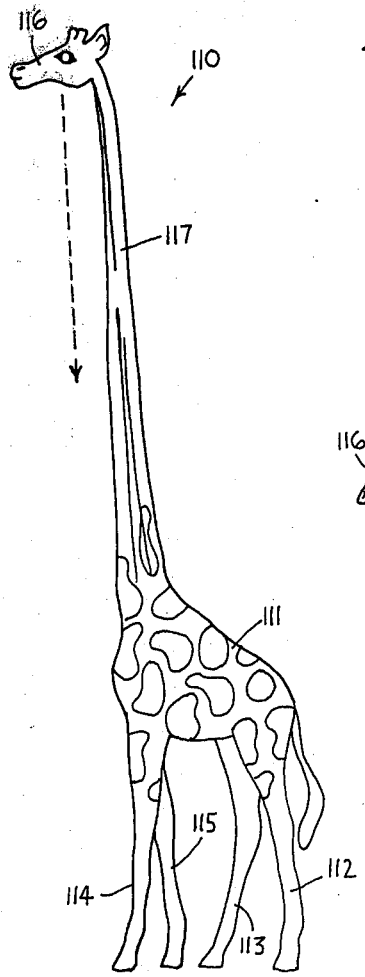
FIG. VII
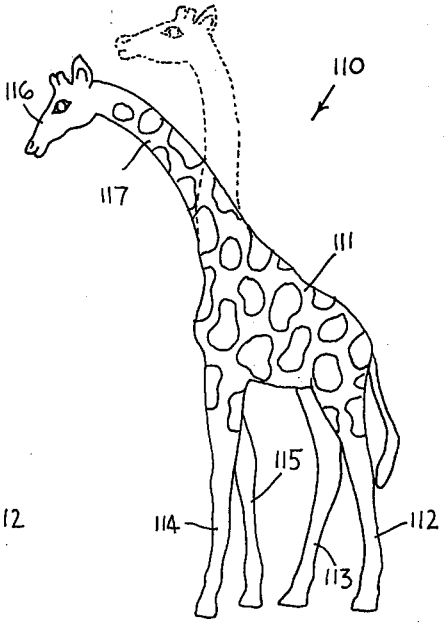
FIG. VIII
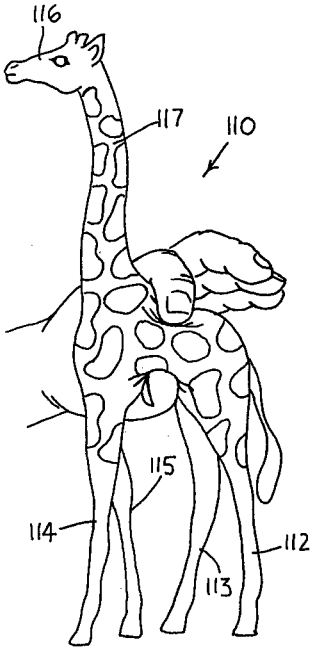
FIG. IX

STRETCHABLE FIGURE EXHIBITING SLOW RECOVERY

This application is a continuation of Application Ser. No. 705,966, filed July 16, 1976 which in turn is a continuation-in-part of application Ser. No. 665,469, filed Mar. 10, 1976; both are now abandoned.

BACKGROUND OF THE INVENTION

The present invention relates to toy figures and more particularly to toy figures having movable limbs or body parts.

In the past, a great deal of creative effort has gone into the design and construction of toy figures such as dolls, animals, and the like. Illustrative of such creacivity was Thomas Edison's doll containing a miniature phonograph record player.

Toy figures having movable limbs and parts are known. Typically, such toy figures have included limbs mounted on hinges of various sorts. Typically, such hinged mechanisms have provided at least minimum movement of the figure body parts; however, as a general rule, they have not provided return means. In other words, if a limb on the figure were moved from one position to a second position, the limb would remain in such second position unless or until it was manually moved to a further position. Other toy figures have had spring return mechanisms for various body parts; however, such return mechanisms have generally snapped the body part back quickly in an unlife-life manner. Such previous toy figures further were generally limited in regard to their points of movement.

An object of the present invention is to provide a toy figure having a variety of life-like movements and includes a toy figure having a memory such that a limb or body part may be moved from one position to another manually and, when released, will slowly return to the original position. Typically, a giraffe may include a neck that may be bent to simulate an eating position and may be released to return to its normal upright position. Another object of the present invention is to provide a toy figure having an elastic skin which is bendable and stretchable, yet one which returns the figure to its original shape and position. The toy figure has a viscous filling that impedes such bending and stretching, giving a life-like feeling. Another object of the invention is to provide a toy figure having limbs and body portions which will yield when squeezed thereby distorting the shape of the figure, yet a memory such that the body part will then return to its original shape upon release. An object of the invention is to provide a toy figure that may be stretched, squeezed, distorted, balled-up, flattened, fattened and the like. A further object of the present invention is to provide a toy figure having a wide variety of types of movements, including hinge-like movements, for example, at the knee or elbow, a stretching movement such as elongation of a neck or leg member, and a compression movement providing give when squeezed.

The present invention provides a toy figure of any desired shape. For example, the toy figure may be a doll in the shape of a muscular man or a shapely woman. The toy figure may alternatively be in the form of an animal shape such as a giraffe, an elephant or a pig. In each instance, however, the figure will include an elastic skin having a memory and a highly viscous filling material.

The skin material may be any elastic film material having a memory. Suitable material includes natural rubber, as well as synthetic rubber. The elastic film is first formed into the desired shape such as the shape of the human body or that of an animal body. This skin manufacturing process may be carried out in a manner similar to that used in preparation of shaped expandable ballons. Desirably, this elastic skin has elongation characteristics permitting stretching of at least 300 percent of its original dimensions and yet returning to its original dimensions upon release. It also has characteristics that permit repeated stretching and distorting.

An important characteristics of the skin is its capability of stretching while under stress and returning to its original size upon release of the stress. It is desirable to provide a skin in the present invention which requires a degree of stress in order to provide elongation. The usual measure for such stress-elongation relationship is Young's Modulus of Elasticity which may be measured in pounds per cross-sectional square inch (hereafter p.s.i.) of skin required to give a particular percentage of elongaticn. The skin of the present invention desirably has a Modulus of Elasticity of at least 200 p.s.i. at an elongation of 300% and up to 800 p.s.i. at an elongation of 800%. A preferred skin has a Modulus of Elasticity of between 350 and 500 p.s.i. at 500% elongation. Of course, one may utilize a skin material requiring a higher or lower degree of stress to provide elongation by increasing or decreasing the thickness of the skin and/or by appropriate adjustment of the viscosity of the filling material.

The filling material is a fluid having a high viscosity at room temperature. The particular chemical composition of the viscous fluid is not critical to the present invention so long as the fluid does not destroy the skin material. Instead, it is the physical characteristics that are important. The viscosity typically is in the range of $5\times10^3$ centipoises to $5\times10^8$ centipoises, preferably $1\times10^6$ to $1\times10^7$ centipoise. In other words, the filling material when under the normal stress imposed by usage remains in such viscosity range. The filling material also has an adhesive character (i.e., sticky) such that it adheres to the skin material when the skin is stretched. The filling material also has cohesive properties such that the filling material will flow and not separate or break when the skin body parts are stretched. The fluid maintains a constant viscosity while under shear. A variety of filling materials exhibit the aforementioned physical characteristics. The preferred such materials are aqueous sugar solutions, such as molasses, corn syrup, honey, as well as solutions of other sugars such as sucrose, glucose and the like. Other representative materials are pine pitch, rosin and asphaltum. It is also preferred that the filling materials be non toxic, although this is not essential.

The filling material may also include various inert particulate material such as limestone, talc, wood flour and other materials which may serve to increase or decrease the weight of a given volume. The inert particulate material may also serve to reduce the cost of the composite filling material.

The present invention may be illustrated by reference to the following drawings:

FIG. I is a doll according to the present invention in which certain portions are broken away to show the underlying material;

FIG. II illustrates a view similar to FIG. I: however, having a limb that has been moved;

FIG. III is a view similar to FIG. I; however, with a body portion which has been stretched;

FIG. IV is the doll of FIG. I which has been highly distorted;

FIG. V illustrates the doll of FIG. I partially disassembled;

FIG. VI is an animal figure according to the present invention in which certain portions are broken away to show the underlying material;

FIGS. VII-IX illustrate various movements of the animal of FIG. VI.

DETAILED DESCRIPTION

The toy figure 10 (FIGS. I-V) may be in the form of a doll having the usual human features including a body portion 11, a pair of legs 12 and 13, a pair of arms 14 and 15, as well as a head portion 16. The leg portion 12, for example, may include a thigh 18, a calf portion 19, and a foot portion 21. The arm portion 14 may include an upper arm 22, a lower arm 23, and a hand portion 24. The leg portion 12 and the arm portion 14 may be shaped so as to illustrate the muscular construction of the leg and arm respectively. The body portion 11, legs 12, 13 and the arms 14, 15 may be constructed of a skin 31 of elastic film such as neoprene, natural or synthetic rubber, typically, having a thickness in the range of 0.02 to 0.55 inch, preferably about 0.038±0.005 inch. The skin 31 should be completely filled with a suitable high viscosity material, preferably an aqueous solution of corn syrup solids 32, desirably the entire figure provides intercommunication between body parts. In other words, the corn syrup solids from body portion 11 may be squeezed and moved from one location to another. During the filling process care should be exercised to assure that there is no air entrapment.

The head portion 16 may be constructed in a manner similar to the body, i.e., constructed of a thin elastic film and flowable viscous fluid. Alternatively, the head portion 16 may be separate and distinct from the body. The head portion 16, for example, may be hollow molded plastic or carved from a block of plastic or wood. Manufacture of such an article as doll 10 generally necessitates existence of an opening into the body cavity through which the viscous material may be added. One approach is to provide an opening 33 (FIG. V) at the upper portion of the body where the neck joins the body. A plug 34 may be inserted into opening 33 and held therein by an "O" ring 35. The head 16 may include a recess 36 into which the upper portion of plug 34 may extend. The plug 34 may be held in recess 36 by conventional snaps or an adhesive. In so doing, the head portion 16 may be attached after filling of the body cavity, thereby concealing the opening into the body cavity.

FIGS. II through IV illustrate a few of the many movements which may be carried out by the doll 10. FIG. II, for example, illustrates the movement accomplished when a child may grasp the doll's foot 21 and makes a hinged like movement at the knee. The high viscosity of the filling resists such movement (or in other words, slows such movement) thus providing a feeling that the leg member is resisting movement. Once the foot is released, the leg then assumes its original position and the lower portion of the leg pivots downwardly as illustrated by the broken arrow in FIG. II. Alternatively, if the child grasps the doll by the foot and pulls, the leg 12 will resistably elongate as shown in FIG. III. Once the foot is released, the leg slowly contracts to its original position and shape. FIG. IV shows doll 10 in a highly distorted condition.

Another embodiment 110 of the present invention is disclosed in FIGS. VI through IX. In this instance, the toy figure is in the shape of a giraffe and includes a body portion 111, a pair of front legs 114 and 115 and a pair of rear legs 112 and 113. The giraffe 110 may further include an elongated neck 117 and a head portion 116. The body of giraffe 110 including portion 111, legs 112-115 and neck 117 may be constructed of an elastic film 131 and a flowable, high viscosity filling such as an aqueous solution of corn syrup solids 132. The head 116 may be constructed either solid or hollow of such material as plastic, wood or metal. Alternatively, it may be constructed of an elastic film and a viscous filling material.

The giraffe 110 is capable of a variety of movements as illustrated in FIGS. VII through IX. In FIG. VII the neck 117 of the giraffe has been pulled to stretch or elongate the neck. Once the neck 117 is released, it returns to its original size as illustrated by the broken arrow in FIG. VII. The giraffe 110 is also capable of various bending movement as illustrated in FIG. VIII where the giraffe's neck 117 has been bent to simulate an eating position. Once the neck 117 is released, it returns to its original position. A further movement is shown in FIG. IX where the body is squeezed and thus compressed in the midsection. When released, the body portion again assumes its original shape. In each of the movements, the elastic skin urges the body portion to return to the original shape and position. The viscous filling material on the other hand, resists the initial movement causing the figure to feel as though it is alive. The viscous material also slows the return movement, again giving a feeling of life.

A doll, for example, may be prepared according to the present invention by coating a mandrel, having the desired shape, with a coagulant to induce the skinning of the latex onto the mandrel. The mandrel is then dipped into uncured liquid latex. The dwell time in the liquid latex determines the thickness of the skin buildup on the mandrel. A skin thickness ranging between 0.01 and 0.06 inch is considered suitable; however, a more desirable thickness is in the range of 0.03 to 0.045 inch. The latex coated mandrel is removed from the liquid latex and placed in an oven at a suitable temperature and time to cure the latex. The mandrel and cured latex coating or skin are cooled and the skin is then stripped from the mandrel. The skin is now washed in hot water to remove residual coagulant and water soluble contaminates. The skin, if desired, may be immersed in a dilute aqueous solution of chlorine bleach, hydrochloric acid or other chlorine containing compounds. This treatment eliminates skin tackiness and produces an etching and dullness. The etched skin may be thoroughly rinsed in clean water.

The resulting skin may be filled with a corn syrup having a high viscosity. The syrup may be prepared from a dilute corn syrup having, for example, about 75 to 85 percent solids content, preferably about 80 percent and a dextrose equivalent of about 28 to 45, typically 42 percent. The dilute corn syrup generally has a viscosity of between about 300 and 550 poises at 70° F., typically about 490 poises. The dilute corn syrup may be heated in an evaporator to reduce the moisture content and increase the solids content to as much as 93 percent or more, preferably about 87.5 percent. The resulting viscosity may be about $5\times10^3$ to $5\times10^8$ centipoises at 70° F. and desirably about $1\times10^7$.

The following are examples of preparation of suitable viscous fluids for the present toy figure.

EXAMPLE I

A viscous fluid suitable for use in the present invention was prepared from corn syrup solids including 9 percent dextrose, 10 percent maltose, 12 percent maltotriose and 69 percent higher saccharides, dry weight basis. The saccharide mixture had a dextrose equivalent of 29. The viscous fluid had a moisture content of 22.5 percent and a saccharide content of about 77.5 percent. The viscosity of the fluid was $7.3\times10^4$ centipoise at 80° F.

EXAMPLE II

A suitable fluid was prepared of corn syrup solids including 12 percent dextrose, 26 percent maltose, 15 percent malto-triose and 47 percent higher saccharides, dry weight basis. The dextrose equivalent was 43. The aqueous fluid had a solids content of 80.3 percent and viscosity of $5.6\times10^4$ centipoises.

EXAMPLE III

A fluid was prepared as described in Example II except moisture was removed in an amount sufficient to provide a solids content of 87.7 percent and a viscosity of $1\times10^7$ centipoises. An excellent fluid was provided.

EXAMPLE IV

A toy figure fluid was prepared as described in Example I; however, the saccharide mixture included 19 percent dextrose, 14 percent maltose, 12 percent maltotriose and 55 percent higher saccharides, dry weight. The dextrose equivalent was 43 and the solids content was 80.3 percent. The viscosity was $8.6\times10^4$ centipoises.

EXAMPLE V

A fluid was prepared as described in Example IV except moisture was removed to provide a solids content of 86 percent and a viscosity of $1\times10^6$. An excellent fluid was obtained.

EXAMPLE VI

A corn syrup fluid was prepared in which the saccharide mixture included 35.5 percent dextrose, 30 percent maltose, 13 percent malto-triose, and 21.5 percent higher saccharides, dry weight. The solids content of the fluid was 81.7 percent and the viscosity was $2.2\times10^4$.

EXAMPLE VII

A suitable fluid was prepared using a pine pitch mixture (75 percent medium nelio resin and 25 percent nelio gum rosin, products sold by Union Camp Co.). The viscosity was $1\times10^9$ centipoises.

EXAMPLE VIII

A preferred fluid was prepared including 71.7 percent of the saccharide solution of Example V and 28.3 percent of micro white limestone having an average particle size of 50 microns.

EXAMPLE IX

Another preferred fluid was prepared including 68.8 percent of the saccharide solution of Example V and 28.3 percent glass beads having a particle size in the range of 10 to 19 microns. The viscosity was $1.2\times10^6$ centipoises.

Various modifications may be made without departing from the scope of the present invention. The toy figure may be a cow, a horse or a fish. Alternatively, the toy figure may simulate an automobile or a tall building. A variety of elastic film materials may be used for the skin and various other viscous filling materials may be used.

The embodiments of the invention in which an exclusive property or privilege is claimed are defined as follows:

1. A toy figure having a shape including a limb or body part which may be moved from one position to another manually and, when released, will slowly return to the original position comprising (1) a shaped elastic skin, said skin having a memory and elongation characteristics permitting stretching of at least 300 percent of its original dimensions and yet returning to such dimensions upon release of the stretching tension, and (2) a viscous liquid filling material sealed inside the shaped elastic skin, said filling material having a viscosity in the range of $5\times10^3$ centipoises to $5\times10^8$ centipoises at 70° F. which viscosity remains constant under shear, cohesive properties such that the same will flow and not separate when the shaped elastic skin is stretched, adhesive characteristics such that the same adheres to the shaped elastic skin when the skin is stretched and a chemical composition such that it will not destroy the shaped elastic skin.

2. The toy figure of claim 1 wherein said shaped elastic skin is composed of a material selected from the group consisting of natural and synthetic rubber and has a thickness of between about 0.02 to 0.055 inches.

3. The toy figure of claim 1 which has the shape of a human.

4. The toy figure of claim 1 which has the shape of an animal.

5. The toy figure of claim 1 wherein the viscosity of said filling material is between $1\times10^6$ and $1\times10^7$ centipoises.

6. The toy figure of claim 1 wherein the filling material is an aqueous sugar solution.

7. The toy figure of claim 6 wherein the filling material is corn syrup.

* * * * *

UNITED STATES PATENT AND TRADEMARK OFFICE

CERTIFICATE OF CORRECTION

PATENT NO. : 4,169,336

DATED : October 2, 1979

INVENTOR(S) : James O. Kuhn

It is certified that error appears in the above-identified patent and that said Letters Patent are hereby corrected as shown below:

Column 1, line 31 - "unlife-life" should read -- unlife-like --.

Column 2, line 13 - "characteristics" should read -- characteristic --.
line 39 - "centipoise" should read -- centipoises --

Column 3, line 27 - "0.55 inch" should read -- 0.055 inch --.

Column 4, line 23 - "movement" should read -- movements --.

Signed and Sealed this

*Eighteenth* Day of *March 1980*

[SEAL]

*Attest:*

SIDNEY A. DIAMOND

*Attesting Officer*

*Commissioner of Patents and Trademarks*